US005487655A

United States Patent [19]

Frey et al.

[11] Patent Number: 5,487,655

[45] Date of Patent: Jan. 30, 1996

[54] METHOD OF AND APPARATUS FOR PRODUCING A SPUN FILAMENT WEB

[75] Inventors: Detlef Frey, Troisdorf; Bernd Masbach, Siegburg, both of Germany

[73] Assignee: Reifenhauser GmbH & Co. Maschinenfabrik, Troisdorf, Germany

[21] Appl. No.: 226,598

[22] Filed: Apr. 11, 1994

[30] Foreign Application Priority Data

Apr. 15, 1993 [DE] Germany ..... 43 12 309.0

[51] Int. Cl.[6] ..... B29B 13/02; B29C 33/02

[52] U.S. Cl. ..... 425/72.2; 425/140; 425/141; 425/144; 425/378.2

[58] Field of Search ..... 425/140, 141, 425/143, 144, 378.2, 72.2

[56] References Cited

U.S. PATENT DOCUMENTS

| | | | |
|---|---|---|---|
| 4,295,809 | 10/1981 | Mikami | 425/141 |
| 4,352,649 | 10/1982 | Jacobsen | 425/141 |
| 4,790,736 | 12/1988 | Keuchel | 425/144 |
| 4,797,079 | 1/1989 | Balk | 425/140 |
| 4,820,142 | 4/1989 | Balk | 425/141 |
| 5,080,569 | 1/1992 | Gubernick | 425/378.2 |

*Primary Examiner*—Jenna L. Davis
*Attorney, Agent, or Firm*—Herbert Dubno

[57] ABSTRACT

A spin blowing apparatus for producing spun fleece of thermoplastified synthetic resin provides that the spinneret plate and/or the fiber or filament blowing gap through which the blowing air/fiber mixture passes downwardly and/or the air flow resistance of the perforated belt upon which the fleece is collected can be varied in response to measured values of the specific weight and/or air permeability of the web to restore any deviation of the latter.

6 Claims, 4 Drawing Sheets

METHOD OF AND APPARATUS FOR PRODUCING A SPUN FILAMENT WEB

FIELD OF THE INVENTION

Our present invention relates to the spin blowing of filament and, more particularly, to the production of a nonwoven web, fleece or mat of thermoplastic synthetic resin filaments by a spin blowing process.

BACKGROUND OF THE INVENTION

In DE 4036734 C1, for example, a spin blowing process and apparatus for producing a spun fleece web are described in which a multiplicity of filaments emerging from the nozzle orifices of a nozzle plate or spinneret, constituted of thermoplastified synthetic resin, are entrained in flat streams of air delivered to the region of the orifice plate by appropriate ducts and slot-like air nozzles, to generate a descending curtain of the filaments and the entraining air through a gap.

This gap which is elongated to extend across the entire working width of the apparatus and of the web, is formed in the spin-blowing head disposed above a continuously moving sieve belt upon which the blowing air/filament mixture descends so that the fibers collect upon the belt to form a mat or fleece which can, if desired, be consolidated between calender rolls or can be recovered as a nonwoven mat or fleece, hereinafter referred to as the web. The fibers which accommodate to form the fleece or web can be collected against the belt by reason of a subatmospheric pressure or suction generated below the belt if desired. The spin blown web which is formed has wide applications as absorbent materials, fabrics for a wide variety of purposes, fillings and the like. The spun-fiber fleece can be produced with a variety of mechanical properties, such as the specific weight and the specific air permeability of the web. The term "specific" is here used to refer to the property per unit area.

In general, it is important that these properties be as homogeneous as possible and it has been found that the uniformity of the specific weight (weight per unit area) and specific air permeability (air permeability per unit area) can depend upon the microstructure of the fibers and, especially, the deviations from homogeneity can be corrected during the process of fabricating the spun fiber fleece or web. In particular, we have determined that factors like the pore size or so-called mesh width of the collected fibers which are dependent upon the microstructure of the fibers and the microstructure with which they unite with one another in the fleece or web, can be influenced positively during the fabrication process.

OBJECTS OF THE INVENTION

It is, therefore, the principal object of the present invention to provide a process for producing a spun fiber fleece which ensures a highly uniform or homogeneous distribution of the mechanical properties described in the web and which allows, in particular, the elimination of detrimental local inhomogeneities.

Another object of the invention is to provide an improved process for producing a spun filament or spun fiber web which overcomes drawbacks of earlier processes and is capable of producing, over comparatively long production runs, especially high quality uniform spun fiber fleeces or webs.

It is also an object of this invention to provide an apparatus which allows the process of the invention to be carried out simply and economically.

SUMMARY OF THE INVENTION

These objects and others which will become apparent hereinafter are thus attained, in accordance with the invention, in the production of a spun fleece web of fibers of thermoplastic synthetic resin with the aid of a fleece blowing head having a nozzle or orifice plate (spinneret) with at least one row of orifices for the thermoplastified synthetic resin, flow ducts for flat blowing air streams or jets entraining the blowing air/fiber mixture through an outlet gap of the head, and a depositing or collecting device or means with a continuously moving sieve belt upon which the fibers are collected in the spun fleece.

For the purpose of controlling and/or regulating the weight per unit are and/or the air permeability of the spun fleece web product, at least one of the following parameters, namely, the orifice plate temperature, the outlet gap width and the air flow resistance of the collecting device, is varied in the course of the web forming operation.

More particularly, the process according to the invention can comprise the steps of:

(a) feeding a thermoplastified synthetic resin downwardly in respective filaments from a multiplicity of orifices in a spinneret in a form of an orifice plate at a temperature constituting a first parameter;

(b) entraining the filaments in flat filament-blowing streams of air directed at the filaments adjacent the spinneret in a downwardly moving curtain of filaments and air through a slot-shaped outlet gap in a filament-blowing head having a length corresponding to a width of a web to be produced, the outlet gap having a gap width constituting a second parameter;

(c) collecting the curtain of filaments below the head upon a continuously moving sieve belt to form a nonwoven web of the filaments of the curtain on the belt with properties of weight per unit area and air permeability of the web, air flow resistance through the belt constituting a third parameter; and (d) during formation of the web on the belt continuously controlling at least one of the parameters to regulate at least one of the properties.

Preferably, according to the invention, at least one of the above mentioned parameters is locally varied in accordance with deviations of locally obtained measurements of the weight per unit area and/or the air permeability of the spun fleece web product from a respective setpoint value.

By locally obtained measured values which may deviate from the setpoint value, we mean to indicate that the spun fleece web product is monitored at a multiplicity of locations across its width over areas which are small by comparison to the overall area of the web so that local deviations from the setpoint value can be readily detected.

The local change in the orifice plate temperature and/or the outlet gap width is intended to mean that the orifice plate and the gap are subdivided into zones or sections which are small by comparison to the length of the orifice plate or the gap and that the temperatures and/or gap width in these local zones can be adjusted independently of the adjustments elsewhere along the orifice plate and the gap. The changes in each case, of course, should be such as to restore equality between the measured or actual value and the setpoint value, i.e. so as to eliminate the deviation.

The invention is based upon the discovery that the temperature of the orifice plate and the gap width, together with the air resistance of the collecting belt strongly affect the properties of the resulting web, in part because they influence the manner in which the fibers collect upon one another, and that the specific weight and the specific air permeability of the product can be strongly influenced by variation of the orifice plate temperature, the gap width or the air resistance individually or in combination in response to deviations from setpoint values so as to restore such deviations and yield a highly uniform product at least with respect to the properties mentioned.

With the invention, therefore, a low tolerance control or regulation of the mechanical proprieties of the spun fleece product can be obtained.

It is indeed surprising that the speed with which the fibers collect on each other and on the belt can be varied not only by the air resistance of the belt and the collecting device generally, but also by the thickness of width of the gap and the temperature of the orifice plate.

Apparently the contribution of the temperature of the orifice plate to the result is a consequence of the change in viscosity of the thermoplastic which variations in the temperature of the orifice plate bring about.

It is especially advantageous that the method can be carried out with relatively simple apparatus utilizing control means known in the art.

More particularly, the apparatus can comprise:

a spinneret in a form of an orifice plate at a temperature constituting a first parameter and having a multiplicity of orifices for feeding a thermoplastified synthetic resin downwardly in respective filaments;

a filament-blowing head provided with a slot-shaped outlet gap adjacent the orifice plate and formed with means for entraining the filaments in flat filament-blowing streams of air directed at the filaments in a downwardly moving curtain of filaments and air through the slot-shaped outlet gap, the gap having a length corresponding to a width of a web to be produced, the outlet gap having a gap width constituting a second parameter;

means including a continuously moving sieve belt for collecting the curtain of filaments below the head to form a nonwoven web of the filaments of the curtain on the belt with properties of weight per unit area and air permeability of the web, air flow resistance through the belt constituting a third parameter; and control means operable during formation of the web on the belt for continuously controlling at least one of the parameters to regulate at least one of the properties.

In one apparatus aspect of the invention, therefore, the orifice plate can be subdivided into a multiplicity of individually controllable temperature zones, provided, for example, with respective heaters, and independent control is effective of the temperatures of these zones. The temperature control elements or effectors which vary the temperature of the respective zones can be connected in a control path and/or a regulating circuit for the specific weight and/or air permeability of the spun fleece web product.

Of course corresponding measuring devices are required for the measurement of the actual values.

In accordance with another aspect of the invention, the outlet gap is subdivided into zones which can be delimited between deformation lips or flanks provided with respective effectors for deforming these flanks to vary the gap width locally. Each of these effectors may be connected in a control path or regulating circuit for the specific weight and/or air permeability. Here as well measuring devices are provided for the actual values. Naturally both of these apparatus aspects can be combined if desired.

In a third aspect of the invention, the fiber collecting device can have an air resistance control below the sieve belt, preferably in the form of two perforated plates which can be disaligned to reduce air flow thereto and which can form flow resistance which can be individually controlled across the width of the web. These effectors for regulating the air flow resistance can be connected in a control path or regulating circuit for the specific weight and/or air permeability of the spun fleece web. Measuring devices to obtain the measured value for the control circuit can be provided here as well.

This aspect of the invention can also be combined with the two apparatus aspects previously described.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
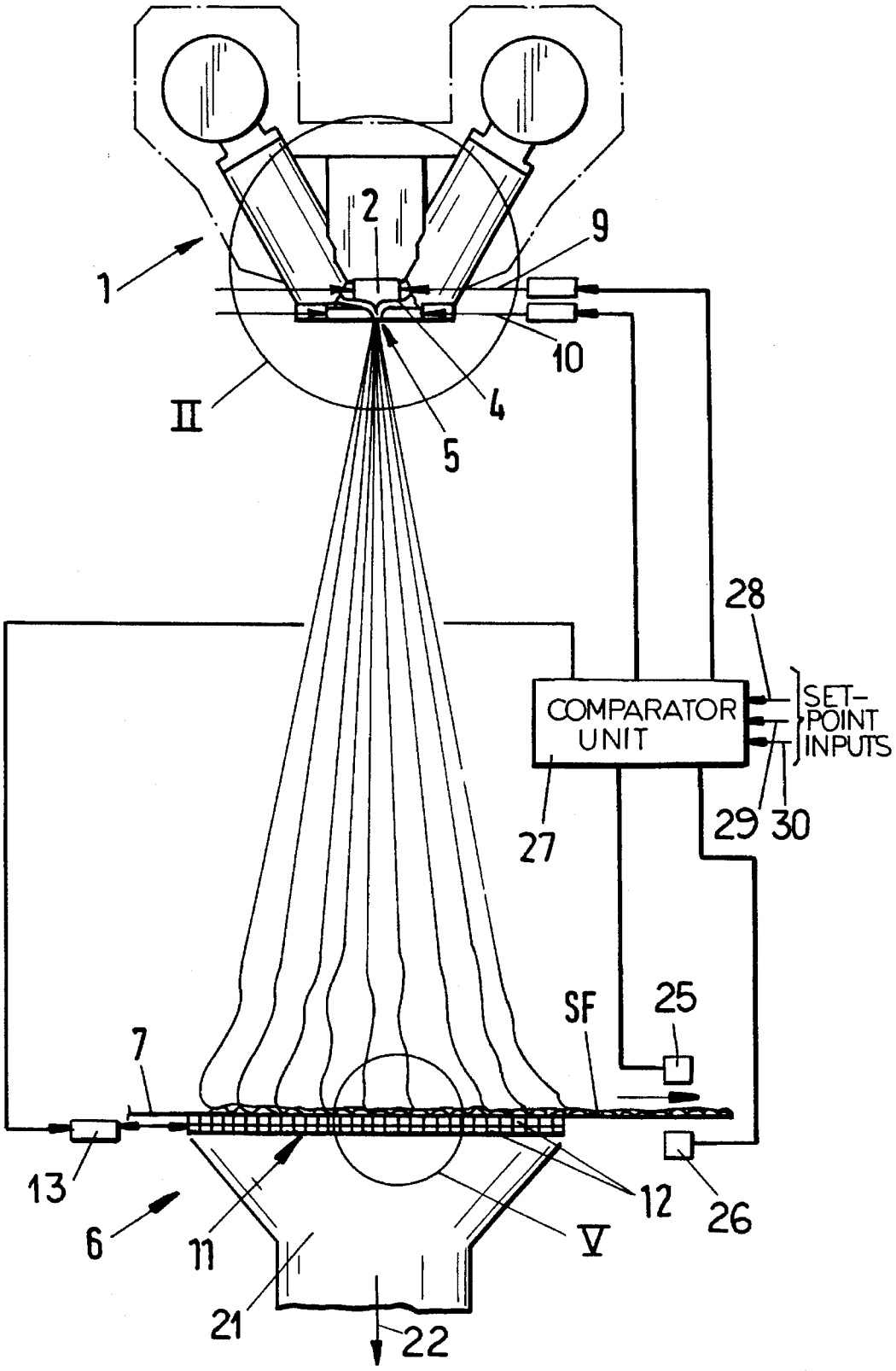
FIG. 1 is a diagram showing an apparatus for producing a spun fleece web utilizing the principles of this invention.

FIG. 1 shows an apparatus for producing a spun fleece web SF, i.e. a nonwoven mat of thermoplastic synthetic resin fibers. The apparatus for this purpose comprises a blowing head 1 which receives a nozzle or orifice plate 2 with at least one row of nozzles or orifices forming a spinneret and from which strands of thermoplastified synthetic resin material emerge in a downward direction.

The blowing head also comprises flow passages 4 for generally flat jets or streams of air from air supply ducts 20, extending across the full width of webs SF and feeding a mixture of fibers and blowing air to an outlet gap 5 which likewise extends the full width of the web.

The principle of operation is clear from the aforementioned German patent document. The thermoplastic synthetic resin flowing in a liquid stand from the orifices is pulled downwardly and broken into fibers simultaneously with cooling or is drawn downwardly in longer filaments to collect on a continuously moving sieve belt 7 forming part of a collection device 6 below the blowing head. Suction can be applied to a plenum 21 via a blowing arrangement represented only at 22 by an arrow in FIG. 1.

From the curtain of filaments or fibers which are blown downwardly onto the surface 7, a mat or fleece is formed with the filaments or fibers bonding together at contact points. The web SF had a mesh width or porosity determined by the number of fibers or filaments per unit area and hence the specific weight.

Figure 2:
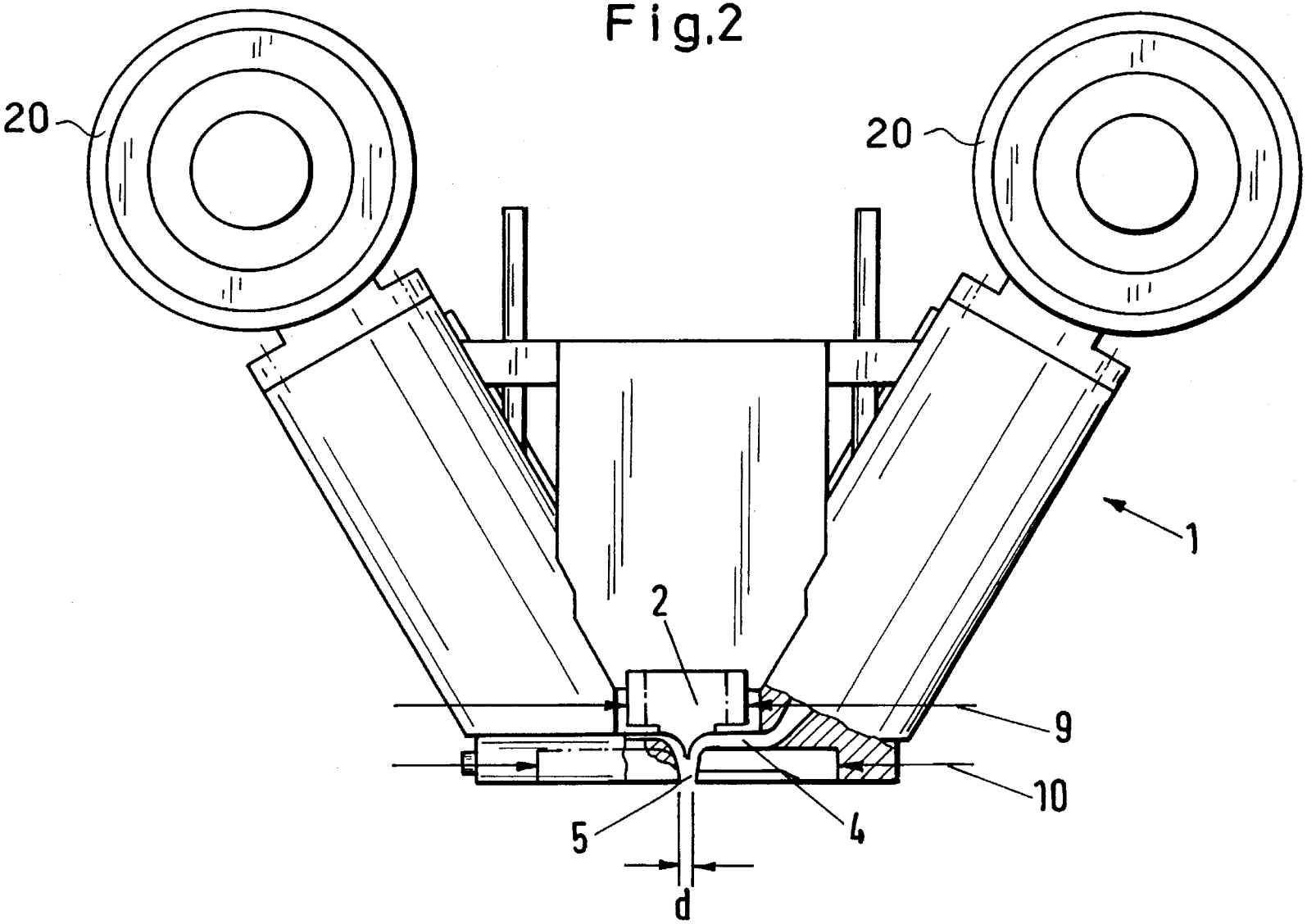
FIG. 2 is a detail of the region II of FIG. 1.
Figure 4:
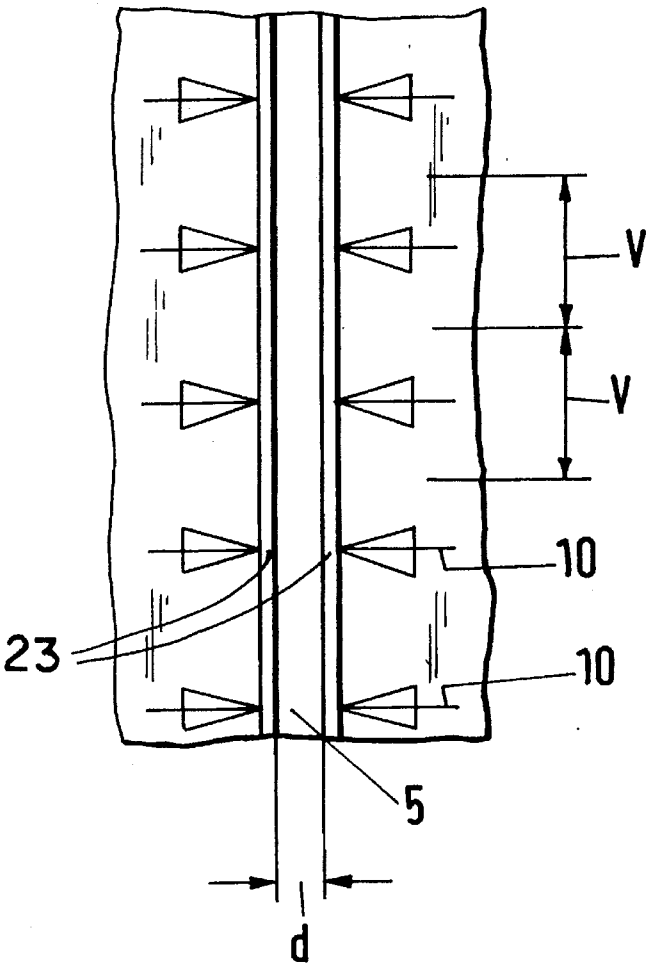
FIG. 4 is a fragmentary bottom plan view of the portion of the blowing head provided with the gap.
Figure 3:
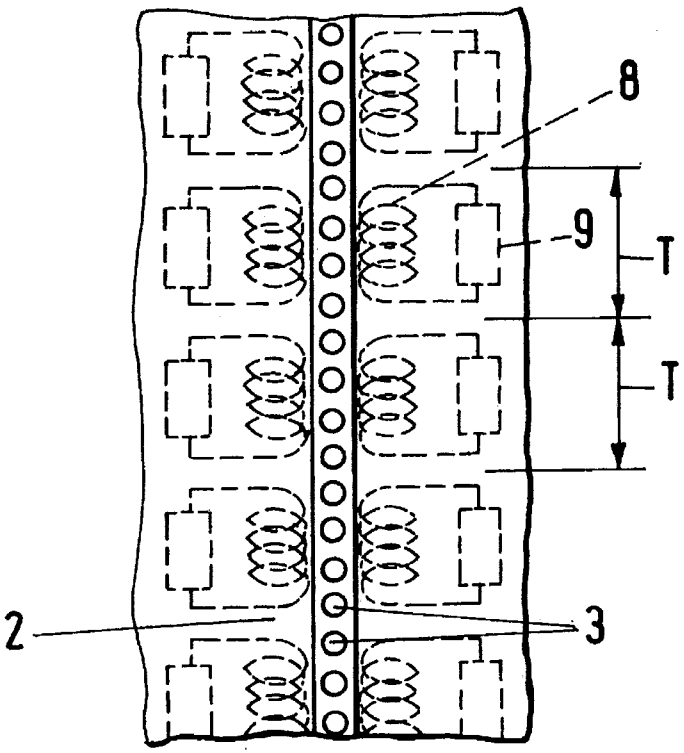
FIG. 3 is a fragmentary bottom plan view of the nozzle plate of FIG. 2.

In FIG. 2, the blowing head has been shown in greater detail whereas FIGS. 3 and 4 show the orifice plate 2 and the gap 5 from below.

With respect to FIG. 2 it can be seen that the orifice plate 2 is subdivided into individually controllable zones T which can be heated by respective electric heating resistances 8 connected to a heating source 9 forming an effector for controlling the temperature of the plate 2 zone by zone. The elements 9 are effectors in a control line or circuit for the specific weight and/or air permeability of the web SF as will be described.

In FIG. 4, the effectors for controlling the width d of the gap 5 locally may be a series of motors represented at 10 which deflect the lips 23 defining the gap 5 at the different locations along the length of the gap.

Figure 5:
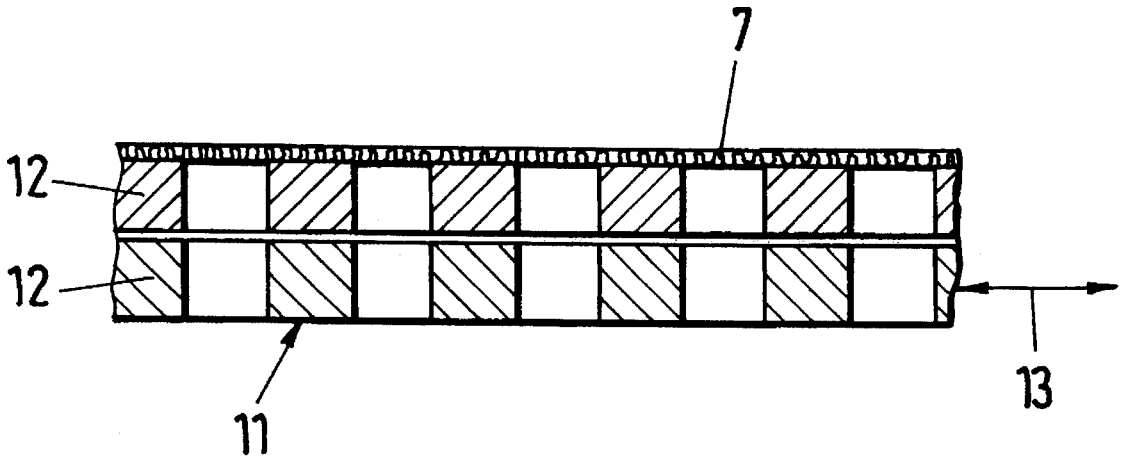
FIG. 5 is a detail cross sectional view of the region V of FIG. 1.
Figure 6:
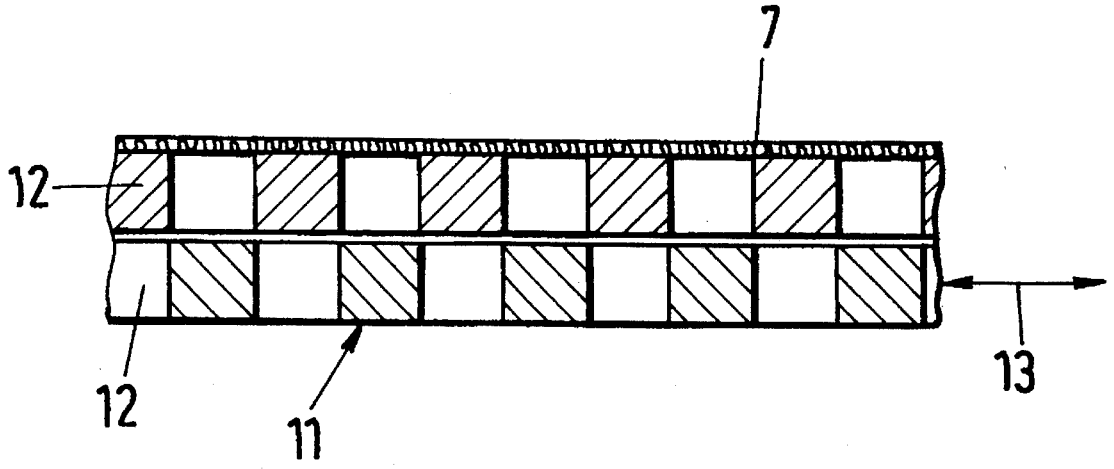
FIG. 6 is a view similar to FIG. 5 showing the parts in another position.

As can be seen also from FIGS. 1, 5 and 6, the collecting device 6 can comprise below the sieve belt 7 flow resistance elements 11 in the form of relatively displaceable perforated plates 12 with a maximum flow cross section when the perforations of the plate are aligned (FIG. 5) and a maximum flow resistance when the perforations are disaligned (FIG. 6). The plates may be subdivided to define zones along the width of the web at each zone being provided and with a corresponding effector, such as a servomotor or hydraulic cylinder 13, enabling the flow resistance to be varied in response to a control stretch or regulating circuit for the specific weight and/or the air permeability of the web.

As can be seen from FIG. 1, measured value signals are generated by arrays of sensors 25 across the width of the web, measuring by indirect sensing techniques, e.g. radiation absorption, the weight per unit area of the web or via the array of sensors 26 spaced across the width, the air permeability of the web. These actual value measures are supplied to the comparator unit 27 which receives setpoint inputs 28, 29 and 30, representing the ideal values of the measured property for the respective effectors 9, 10 and 13 so that the comparator can output error signals to one or more of them and thereby control the local temperature of the plate 2, the local width of the gap 5 or the local air resistance of the collector 6 in a direction tending to eliminate the difference between the respective measured value and the setpoint value.

We claim:

1. A spin-blowing apparatus for producing a nonwoven spun-filament web, comprising:

a spinneret in a form of an orifice plate at a temperature constituting a first parameter and having a multiplicity of orifices for feeding a thermoplastified synthetic resin downwardly in respective filaments;

a filament-blowing head provided with a slot-shaped outlet gap adjacent said orifice plate and formed with means for entraining said filaments in flat filament-blowing streams of air directed at said filaments in a downwardly moving curtain of filaments and air through said slot-shaped outlet gap, said gap having a length corresponding to a width of a web to be produced, said outlet gap having a gap width constituting a second parameter;

means including a continuously moving sieve belt for collecting said curtain of filaments below said head to form a nonwoven web of said filaments of said curtain on said belt with properties of weight per unit area and air permeability of the web, air flow resistance through said belt constituting a third parameter; and control means operable during formation of said web on said belt for continuously controlling at least one of said parameters to regulate at least one of said properties, said plate in a region of said orifices being subdivided into separately controllable heated zones across said width of the web, said one of said parameters being said first parameter, temperatures of said zones being independently controlled in response to said deviation of said actual value from said set-point value.

2. The apparatus defined in claim 1 wherein said control means includes:

means for measuring a local value of at least one of said properties;

means connected to said means for measuring for comparing the measured local value as an actual value with a set-point value of said one of said properties; and means connected to said means for comparing for locally regulating said one of said parameters in response to a deviation of said actual value from said set-point value in a direction so as to cause the measured value to return to the respective set-point value.

3. A spin-blowing apparatus for producing a nonwoven spun-filament web, comprising:

a spinneret in a form of an orifice plate at a temperature constituting a first parameter and having a multiplicity of orifices for feeding a thermoplastified synthetic resin downwardly in respective filaments;

a filament-blowing head provided with a slot-shaped outlet gap adjacent said orifice plate and formed with means for entraining said filaments in flat filament-blowing streams of air directed at said filaments in a downwardly moving curtain of filaments and air through said slot-shaped outlet gap, said gap having a length corresponding to a width of a web to be produced, said outlet gap having a gap width constituting a second parameter;

means including a continuously moving sieve belt for collecting said curtain of filaments below said head to form a nonwoven web of said filaments of said curtain on said belt with properties of weight per unit area and air permeability of the web, air flow resistance through said belt constituting a third parameter; and control means operable during formation of said web on said belt for continuously controlling at least one of said parameters to regulate at least one of said properties, said gap being subdivided into sections across said width of said web individually controllable as to gap width, respective gap widths of said sections being independently controlled in response to said deviation of said actual value from said set-point value.

4. A spin-blowing apparatus for producing a nonwoven spun-filament web, comprising:

a spinneret in a form of an orifice plate at a temperature constituting a first parameter and having a multiplicity of orifices for feeding a thermoplastified synthetic resin downwardly in respective filaments;

a filament-blowing head provided with a slot-shaped outlet gap adjacent said orifice plate and formed with means for entraining said filaments in flat filament-blowing streams of air directed at said filaments in a downwardly moving curtain of filaments and air through said slot-shaped outlet gap, said gap having a length corresponding to a width of a web to be produced, said outlet gap having a gap width constituting a second parameter;

means including a continuously moving sieve belt for collecting said curtain of filaments below said head to form a nonwoven web of said filaments of said curtain on said belt with properties of weight per unit area and air permeability of the web, air flow resistance through said belt constituting a third parameter; and control means operable during formation of said web on said belt for continuously controlling at least one of said parameters to regulate at least one of said properties, a perforated surface being provided below said belt and means is provided to cooperate with said surface for controlling a flow cross section through said surface, said one of said parameters being said third parameter, said means for controlling said flow cross section being adjusted in response to said deviation of said actual value from said set-point value.

5. The apparatus defined in claim 4 wherein said surface and said means for controlling said flow cross section are perforated plates having similar patterns of perforations, one of said perforated plates being shiftable relative to the other perforated plate to selectively disalign the perforations of said perforated plates, thereby regulating air flow through said belt.

6. The apparatus defined in claim 4 wherein said control means includes:

means for measuring a local value of at least one of said properties;

means connected to said means for measuring for comparing the measured local value as an actual value with a set-point value of said one of said properties; and means connected to said means for comparing for locally regulating said one of said parameters in response to a deviation of said actual value from said set-point value in a direction so as to cause the measured value to return to the respective set-point value.

* * * * *